US005570528A

United States Patent [19]

Teetzel

[11] Patent Number: 5,570,528

[45] Date of Patent: Nov. 5, 1996

[54] VOICE ACTIVATED WEAPON LOCK APPARATUS

[76] Inventor: James W. Teetzel, 151 Lafayette Rd., Portsmouth, N.H. 03801

[21] Appl. No.: 488,647

[22] Filed: Jun. 8, 1995

Related U.S. Application Data

[63] Continuation-in-part of Ser. No. 275,128, Jul. 14, 1994, Pat. No. 5,448,847.

[51] Int. Cl.[6] ..... F41A 17/06

[52] U.S. Cl. ..... 42/70.11; 42/70.05

[58] Field of Search ..... 42/70.11, 70.01, 42/70.05, 70.06, 70.08

[56] References Cited

U.S. PATENT DOCUMENTS

| | | | |
|---|---|---|---|
| 4,682,435 | 7/1987 | Heltzel | 42/70.01 |
| 5,062,232 | 11/1991 | Eppler | 42/70.11 |
| 5,459,957 | 10/1995 | Winer | 42/70.11 |

*Primary Examiner*—Stephen M. Johnson
*Attorney, Agent, or Firm*—William B. Ritchie

[57] ABSTRACT

A voice activated locking apparatus for handguns and rifles. The apparatus is designed to fit into handgrips that replace the factory provided handgrips. Flexible membrane circuitry is contained within the handgrips as well as the power source for the apparatus so that the unit does not have to be made part of the weapon and can easily be added at a later time. The only other modification of the weapon that is necessary is to make a slight change to the trigger assembly or trigger bar. The operator speaks into a small microphone exposed to the outside surface of the handle grip so that authentication of the operator's speech pattern is performed. A verified speech pattern by a voice recognition chip unlocks a solenoid mechanism that allows the weapon to be fired. The identifiable speech pattern stored within the voice recognition chip can be reprogrammed for another user via the micrphone and an interface keypad housed on the weapon grip.

3 Claims, 2 Drawing Sheets

VOICE ACTIVATED WEAPON LOCK APPARATUS

This application is a continuation-in-part of U.S. patent application Ser. No. 08/275,128, filed Jul. 14, 1994, now U.S. Pat. No. 5,448,847.

BACKGROUND OF THE INVENTION

1. Field of the Invention

The invention relates to electronic gun locks, particularly electronic systems for small arms.

2. Description of the Related Art

The need for a reliable lock for a handgun or rifle or shotgun has never been more essential. With numbers of guns owned by citizens increasing at a substantial rate and the fire power of these weapons becoming greater, a loaded firearm in the hands of a minor or unauthorized person often results in catastrophic consequences. Typical safety mechanisms such as trigger locks are difficult to remove quickly which makes them unsuitable for locking firearms which must be ready for use at a moment's notice.

U.S. Pat. No. 5,168,114, issued to Enget on Dec. 1, 1992, discloses an automatic gun safety device consisting of a mechanism for transmitting radio signals and a receiver attached to the weapon. A solenoid is electrically connected to the receiving mechanism. The solenoid normally engages the trigger of the firearm, so that the firearm can only be fired when the transmitting mechanism is in range of the receiving mechanism and a properly coded signal is being received by the receiving mechanism. U.S. Pat. No. 4,488,370, issued to Lemelson on Dec. 18, 1984, discloses another form of electronic locking apparatus for firearms. This device comprises a passive electronic circuit which is worn on the arm or finger of the person authorized to use the weapon. The system is activated by field energy generated by an electronic circuit supported in the weapon, and generates a signal or code which is short wave transmitted to the weapon's electronic circuit. Once the control signal is generated, a motor or solenoid drives a latch or stop mechanism within the firearm to disable it. U.S. Pat. No. 4,467,545, issued to Shaw, Jr. on Aug. 28, 1984, discloses a safety device responsive to the palm or fingerprint of one or more individuals authorized to fire the weapon. This particular safety device is activated by a heat sensor when the device is held in the hand. Unless the palm or fingerprint of the person holding the device matches a pre-stored pattern, a blocking safety mechanism normally preventing operation of the weapon, is maintained in its "blocking state" and the weapon will not fire.

U.S. Pat. No. 5,016,376, issued to Pugh on May 21, 1991, discloses still another variation of an electronic safety lock for small arms. This disclosure teaches the use of a solenoid actuated or deactuated upon the application of an electronic signal connected to a decoder. A magnetized ring or microchip bearing ring enables authorized users to operate the handgun.

U.S. Pat. No. 5,062,232, issued to Eppler on Nov. 5, 1991, discloses still another safety device for firearms. In this particular disclosure, a code generator is worn on the finger or palm. The code generator can be a microchip, bar code, etc., which is read by a detector in the handgun so that only authorized users can operate the trigger.

U.S. Pat. No. 3,939,679, issued to Barker, et al. on Feb. 24, 1976, discloses still another solenoid activated switching mechanism for disabling a firearm. The solenoid is electrically connected to a signal receiver and decoder, which must receive the proper signal from an external energizer and encoder in order to send the proper release signal to the solenoid.

U.S. Pat. No. 5,022,175, issued to Oncke, et al. on Jun. 11, 1991, discloses a safety arrangement for selectively disabling a firearm. This patent teaches the use of a key pad having a plurality of key buttons which must be pushed in the proper sequence in order to unlock the gun. The gun is locked by means of a rod slidably mounted in the handle and adapted to move relative to the hammer, thereby causing the hammer to be locked unless the proper signal is provided to unlock the gun.

All of the above devices must be intricately incorporated as part of the weapon and, therefore, are extremely difficult to retrofit to existing firearms. Moreover, many of the devices require the weapon to receive a signal or some other form of electronic input from an external source before the trigger can be unlocked. Even though these devices may prove reliable, a need exists for a self-contained locking apparatus that prevents unauthorized personnel from firing the weapon.

An apparatus as described that can be easily adapted to fit a variety of sizes and types of handguns or rifles, that can be retrofitted to existing weapons requiring little modification of the weapon other than replacing the handgrips is not disclosed in the prior art.

SUMMARY OF THE INVENTION

It is an object of the invention to provide a voice activated weapon lock apparatus that can only be activated by the voice of an authorized user.

It is another object of the invention to provide a voice activated weapon lock apparatus that can be easily reprogrammed for another authorized user.

It is still another object of the invention to provide a voice activated weapon lock apparatus that can be contained within the handgrips that correspond to the size and shape of those provided with the weapon at the time of manufacture.

It is still another object of the invention to provide a voice activated weapon lock apparatus with a feature that activates the voice chip only when a voice or noise is detected so that the battery power is conserved.

It is still another object of the invention to provide a voice activated weapon lock apparatus that has a solenoid locking mechanism that prevents the weapon from firing unless it is unlocked by the proper voice pattern of the authorized user.

It is still another object of the invention to provide a voice activated weapon lock apparatus that utilizes flexible circuits completely contained within the handgrips that attaches to the gun frame.

Finally, it is an object of the invention to provide a voice activated weapon lock apparatus that features handgrips that are positioned with screws requiring a special wrench so that the apparatus cannot be removed or tampered.

The invention is a voice activated weapon lock apparatus for a weapon having a trigger that, when pulled, activates a discharge assembly causing said weapon to discharge. A microphone, exposed to the outside surface of handle grip on said weapon, wherein said microphone is positioned for reception of the operator's voice is provided. Locking means, connected to the discharge assembly of said firearm, for preventing the activation of said weapon when said trigger is pulled is also provided. A voice recognition means, connected to said microphone and said locking means, for evaluating the voice received by said microphone to verify that the speech pattern corresponds to only that of the operator is provided. Said voice recognition means causes said locking means to unlock when the operator's speech pattern is matched with that stored in a programmable voice recognition chip. An alternative to recognizing a speech pattern is to select the voice recognition circuitry such that activation of said locking means is via only certain pre-programmed words.

DETAILED DESCRIPTION OF THE INVENTION

Figure 1:
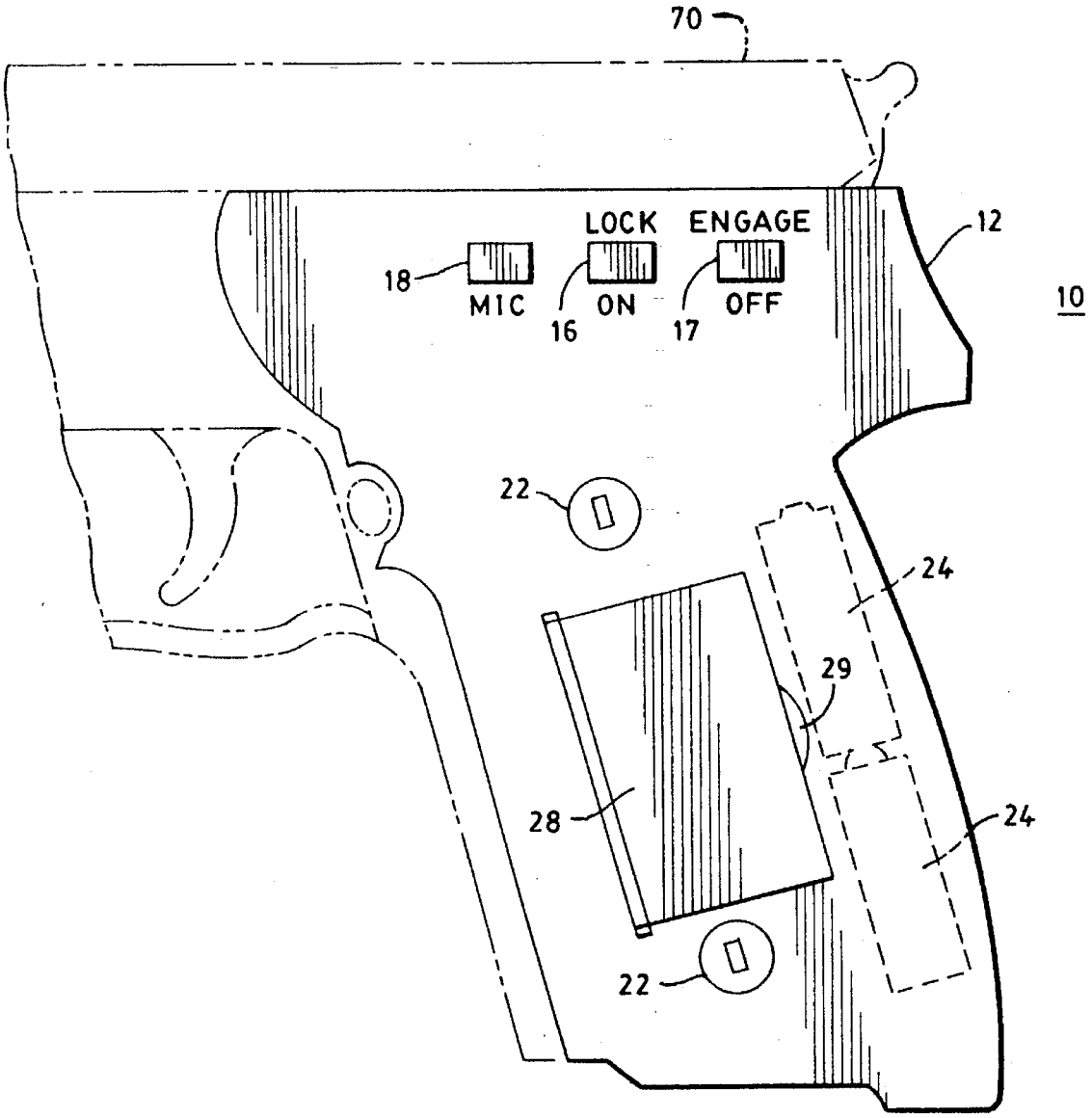
FIG. 1 is a side view of the voice activated lock apparatus in place on a typical semi-automatic handgun.

FIG. 1 is a side view of invention 10 in place on handgun 70. While a typical semi-automatic handgun is shown, any handgun or rifle can be easily adapted as long as the weapon is fitted with handgrips. Handgrip 12 is designed to replace the factory supplied handgrips (not shown). Handgrip 12 is preferably fabricated from durable plastic, sized to match the factory grips.

The layout of the various parts of invention 10 is adjusted to fit in accordance with the particular handgrip that is being utilized. However, the following description is typical and is preferable for the SIG Model P228.

Figure 3:
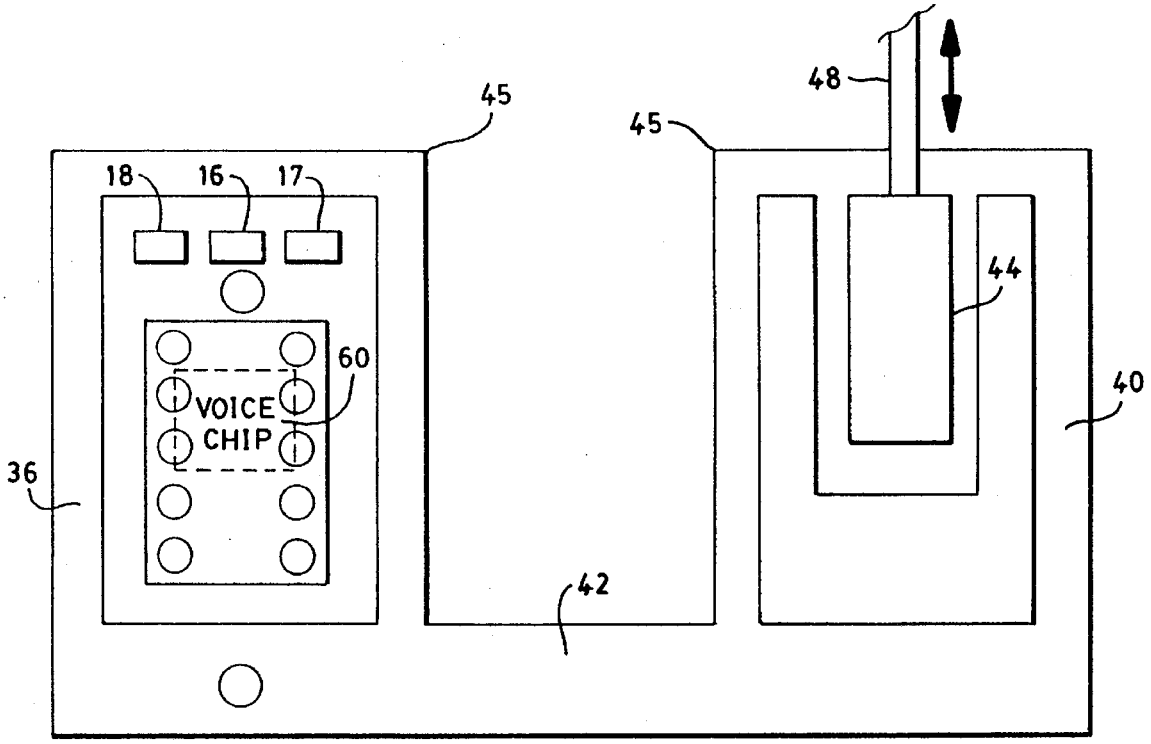
FIG. 3 is a detail view of the flexible membrane circuit board with the weapon lock solenoid attached.

Fitted within grip 12 are LEDs 16 and 17 which are connected to a flexible membrane circuit 45 (shown in FIG. 3). The flexible membrane circuit 45 is fitted within a recess of grip 12. LED 17 is preferably the color "red" to indicate that weapon 70 is in a safe or lock on condition, while led 17 is preferably the color "green" to indicate that weapon 70 is in a "off" or firing position.

Grip 12 is preferably fastened to weapon 70 using special headed machine screws 22 instead of the screws that held the factory installed grips in place. In this manner, someone who wishes to defeat invention 10 would not be able to remove the grips and thus remove the voice activated safety locking abilities of a weapon equipped with the invention.

Shown in phantom are batteries 24 which are also contained with grip 12. Batteries 24 are preferably AA which are easily obtainable and inexpensive. Two batteries 24 are shown, however, other sizes and quantity could be easily substituted without effecting the overall performance of invention 10.

Microphone 18 is exposed to the outer surface of grip 12 and is used to convert acoustical waves from a potential operator's voice into an electric current with is then fed into a voice recognition chip 60 (not shown) for authentication of the operator's speech pattern. Microphone 18 is well known in the art, typical of that used for small portable handheld voice recorders.

Figure 2:
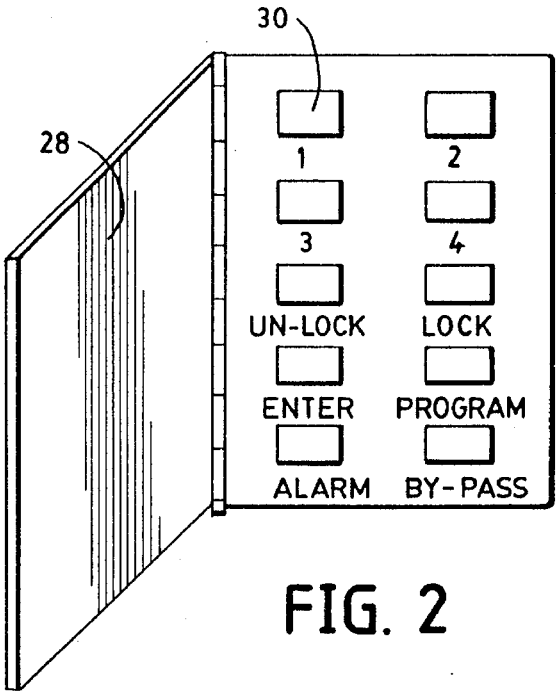
FIG. 2 is an isometric view of the operator keypad.

FIG. 2 is an isometric view of door 28 exposing buttons 30. Finger catch 29 is a small protrusion from door 28 in order to provide easier access to buttons 30. To utilize voice activated safety lock apparatus 10, weapon 70 would be programmed via buttons 30 for the speech pattern of an authorized user after access to the program has been gained by entering in a pre-determined code.

Buttons 30 are preferably rubber buttons having a conductive rubber puck underneath which makes connection with left-hand flexible membrane circuit 36 (shown in FIG. 3). While this type of activation is preferred since it can be made waterproof and is extremely durable, it is not essential to the operation of the invention and other buttons and switches can be substituted, as well as alternative methods of door 28 used to cover buttons 30.

FIG. 3 is an view of flexible membrane circuit 45 showing left-hand portion flexible membrane circuit 36 and right-hand portion 40 connected by circuit strip 42. Solenoid 44 is shown attached to flexible circuit membrane 45. A steel plate (not shown) may be added to the handgrip behind circuit 40 for strength and rigidity. Rod 48 of solenoid 44 is used to lock weapon 70 and prevent it from firing. The necessary modifications to weapon 70 have been previously described in great detail in the prior application.

Voice recognition chip 60 is preferably a single chip well known in the art, that is attached to left-hand portion flexible membrane 36 and controls the operation of invention 10 which will be discussed below. Associated with voice recognition chip 60 is a voice activation function such that chip 60, after turned on by microphone 18, will become energized when a noise or voice is detected. This contributes to a prolonged battery life. Flexible membrane circuit 45 and all the above described attachments are housed within grip 12. Batteries 24 can easily be fit within grip 12.

In operation, weapon 70 is always in the locked position unless microphone 18 picks up the operator's speech pattern and converts the acoustical waves into an electric current which is then fed into voice recognition chip 60 for authentication of the programmed speech pattern. However, a variation of using the operator's speech pattern can be to select voice recognition circuitry that recognizes pre-programmed words such that an operator knowing the correct word will be considered an authorized user to unlock and fire weapon 70.

Once microphone 18 receives the proper voice input as determined by voice recognition chip 60, voice recognition chip 60 activates solenoid 44 which releases rod 48 and the weapon can be fired.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A voice activated locking apparatus for a weapon having handgrips and a trigger that when pulled activates a discharge assembly causing said weapon to discharge, said apparatus comprising:

a microphone, attached to one of said handgrips on said weapon, wherein said microphone is positioned to receive an operator's voice having a speech pattern;

locking means, connected to the discharge assembly of said weapon, for preventing the activation of said weapon when said trigger is pulled;

voice recognition means, connected to said microphone and said locking means, for evaluating the voice received by said microphone to verify that the speech pattern of the voice corresponds to only that of an authorized operator;

operator interface means, connected to said voice recognition means, for initiating recording of the authorized operator's voice pattern by said voice recognition means, such that if the voice pattern received by said microphone is authenticated by said voice recognition means, said voice recognition means causes said locking means to unlock said weapon.

2. The voice activated locking apparatus of claim 1 further comprising:

code input means, connected to said voice recognition means, for allowing operator access to said voice recognition program.

3. The voice activated locking apparatus of claim 2 further comprising:

a power supply attached to said weapon, wherein said power supply provides electrical power to said apparatus, and wherein said voice recognition means further comprises power saving means for turning off said power supply after a pre-selected period of inactivity.

* * * * *